United States Patent [19]

Reiche et al.

[11] 4,194,269

[45] Mar. 25, 1980

[54] APPARATUS FOR REMOVING COTTON OR THE LIKE FROM A BALE

[75] Inventors: Werner Reiche; Hans Trützschler, both of Mönchen-Gladbach, Fed. Rep. of Germany

[73] Assignee: Trützschler GmbH & Co. KG, Mönchen-Gladbach, Fed. Rep. of Germany

[21] Appl. No.: 874,358

[22] Filed: Feb. 1, 1978

[30] Foreign Application Priority Data

Feb. 2, 1977 [DE] Fed. Rep. of Germany ..... 2704240

[51] Int. Cl.[2] ..... D01G 7/06

[52] U.S. Cl. ..... 19/81; 241/101 A; 271/18.3; 294/61; 414/117

[58] Field of Search ..... 214/1 BB, 8.5 R, 8.5 F, 214/152; 19/80 R, 81 X; 271/18.3; 294/61; 414/117, 119, 749, 787, 589, 592; 241/101 A, 283

[56] References Cited

U.S. PATENT DOCUMENTS

| | | | |
|---|---|---|---|
| 940,878 | 11/1909 | Jones | 414/592 X |
| 2,395,411 | 2/1946 | Kittel | 414/589 |
| 3,099,047 | 7/1963 | Morrill | 19/81 X |
| 3,760,956 | 9/1973 | Burch | 414/589 |
| 3,777,908 | 12/1973 | Keller | 214/16 R |
| 3,900,920 | 8/1975 | Whitehurst | 19/81 |

FOREIGN PATENT DOCUMENTS

| | | | |
|---|---|---|---|
| 1510358 | 7/1970 | Fed. Rep. of Germany | 294/61 |
| 1308342 | 2/1973 | United Kingdom | 294/61 |

*Primary Examiner*—Stephen G. Kunin
*Assistant Examiner*—George F. Abraham
*Attorney, Agent, or Firm*—Spencer & Kaye

[57] ABSTRACT

Apparatus for removing a layer of predetermined thickness from a bale of fiber material including an array of rigidly secured, juxtaposed, vertically oriented tines and carriers for moving the tines downwardly to a selected depth in the bale and then horizontally to remove a top layer from the bale.

8 Claims, 1 Drawing Figure

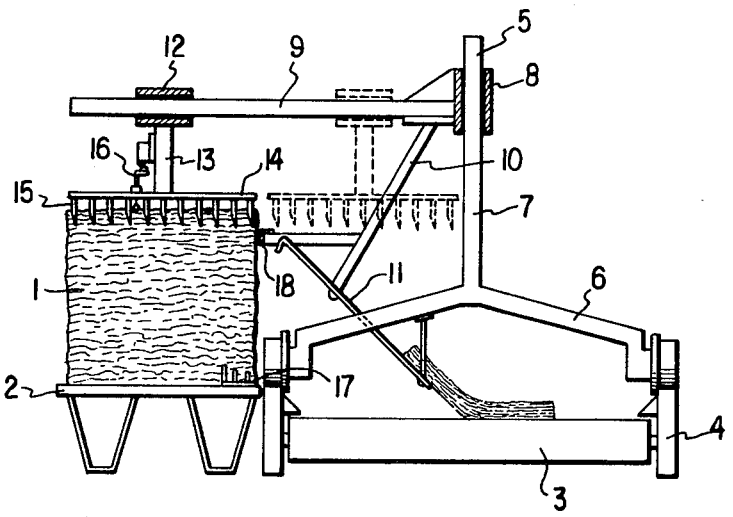
12
9
5
8
16
13
14
10
15
7
1
18
11
6
2
17
4
3

APPARATUS FOR REMOVING COTTON OR THE LIKE FROM A BALE

BACKGROUND OF THE INVENTION

The present invention relates to an apparatus for removing cotton or the like from a bale with the use of tines which penetrate into the fiber material of the bale. Such apparatus can be employed in connection with opening of cotton bales.

A known device of this type is composed of two mutually parallel supports associated with a frame. These supports are equipped with a plurality of parallel juxtaposed tines which can be pivoted inwardly by 90° by means of hydraulic or pneumatic cylinders. The frame can be withdrawn vertically in order to bring the cotton which has been removed from a bale to a depository. It is a disadvantage of this device that the cotton can be removed only by lifting. Moreover, the arrangements provided for this purpose are structurally quite complicated.

SUMMARY OF THE INVENTION

It is therefore an object of the present invention to provide an apparatus for the removal of cotton of the above described type which enables layers of cotton to be removed from a bale toward the side and which is structurally simple.

Due to the fact that the frame and the tines are, for example, horizontally displaceable by hydraulic means, the present invention makes it possible to remove fiber material from the bale in a very simple manner.

To achieve this, the tines penetrate into the uppermost region of the bale. Thereafter, the frame with the tines is laterally displaced to slide along the support so that the upper region gripped by the tines is simply pulled away to the side. This is in contradistinction to the known devices where the fiber material must be lifted off. After the frame has been pushed back over the bale, the support is moved vertically downwardly along the movable frame so that the tines which are fastened to the frame can penetrate the fiber bale anew, likewise in a vertical direction.

The movable frame is here associated with a conveyor belt so that the removed fiber material need be transported only over short distances.

Advantageously the apparatus according to the invention can be used wherever small amounts are involved. Additionally, the amount removed in each pass can be changed immediately with an unlimited number of bales.

According to a preferred embodiment, the penetration depth of the tines can be set by means of an abutment. This depth limitation can be effected, for example, by a cam-like feeler which adjusts a sensing device for scanning the upper layers of the bales. Advisably this abutment is adjustable to any one of several settings in order to set different penetration depths.

Thus it is possible to remove a layer of a certain thickness from a bale. If a sensing device fastened to the carrier rests on the bale, the stroke of the carrier can be regulated automatically. Advisably an obliquely oriented guide blade is provided at the frame and is likewise mounted to be vertically movable. This arrangement makes it possible for the removed layers to reach the conveyor belt in a controlled manner, while a laterally provided layer abutment serves to facilitate separation of the uppermost layer from the layer therebelow.

In particular, this prevents the layer therebelow from also being pulled away.

According to a further preferred embodiment of the invention, the frame is arranged to be movable on walls which delimit the conveyor belt. In this way the bale can be disposed immediately adjacent the conveyor belt.

BRIEF DESCRIPTION OF THE DRAWING

The sole FIGURE is a front elevational view of a preferred embodiment of the invention.

DESCRIPTION OF THE PREFERRED EMBODIMENTS

The FIGURE shows a fiber bale 1 which is disposed on a pallet 2 next to the conveyor belt 3 of a bale opener. A frame 5 with a support 6 and a vertical rod 7 is mounted on wheels for movement along the walls 4 of the bale opener.

A tubular sleeve 8 is movably mounted on rod 7 and a horizontal carrier 9 as well as a mount 10 for an obliquely oriented layer guide metal sheet 11 are attached to this tubular sleeve 8. A further tubular sleeve 12 is movably arranged on carrier 9 and a mount 13 carrying a horizontally disposed frame 14 is secured to tubular sleeve 12.

Frame 14 is provided with a plurality of juxtaposed, rigid, vertically downwardly oriented tines 15. Mount 13 carries a sensing device 16. On the side of pallet 2 which faces the conveyor belt 3, an abutment including three cams 17 is provided to set a certain layer thickness that is to be removed. In addition, an abutment 18 is carried by mount 10 to limit the depth to which material is removed from the bale.

The sensing device 16 is known from U.S. Pat. No. 3,777,908.

In operation, carriage 6 is rolled along walls 4 to come next to a bale 1 to be opened. Thereafter, frame 14 with tines 15 is moved along carrier 9 by horizontally displacing sleeve 12. By then lowering sleeve 8 on rod 7, the carrier 9 is moved vertically downwardly so that the tines 15 disposed at frame 14 penetrate into the uppermost layer, or stratum, of bale 1 to a depth determined by sensor 16. When sensor 16 contacts the top of the bale or is moved a certain distance in the vertical direction until tines 15 have penetrated to a certain depth, the sensor produces a suitable indication or provides a signal that acts to terminate downward movement of carrier 9. Thereafter sleeve 12 is moved horizontally along carrier 9 in the direction toward the conveyor belt 3. This causes the uppermost layer of cotton to be laterally pulled out by the penetrating tines. The layer abutment 18 here delimits the lower extremity of the layer to be removed and prevents the material therebelow from being carried along.

As soon as the uppermost layer leaves the region of the bale 1, this layer is released from the tines 15, essentially under its own weight, and drops onto the obliquely oriented guide metal sheet 11 to move from there onto the conveyor belt 3. At this moment, sleeve 12, mount 13 and frame 14 with tines 15 are in the position shown in dashed lines.

It will be understood that the above description of the present invention is susceptible to various modifications, changes and adaptations, and the same are intended to be comprehended within the meaning and range of equivalents of the appended claims.

What is claimed is:

1. In the combination of a bale opener having a conveyor belt and side walls extending along the belt in the conveying direction thereof, and apparatus for removing cotton or the like from a stationary bale, which apparatus includes a first frame, a plurality of tines for penetrating into the fiber material of the bale, the tines being secured to the frame in juxtaposition with one another, a carrier supporting the first frame for horizontal displacement, and a second frame supporting the carrier for movement in a vertical direction to push the tines into the upper layer of a bale, the improvement wherein: said tines extend vertically and are rigidly fastened to said first frame; and said apparatus further comprises a carriage supporting said second frame and including means disposed to be movable along said side walls of said bale opener for permitting horizontal movement of said carriage parallel to the conveying direction of said belt.

2. An arrangement as defined in claim 1 further comprising abutment means for setting the penetration depth of said tines into the bale.

3. An arrangement as defined in claim 2 wherein said abutment is adjustable in stages.

4. An arrangement as defined in claim 1 further comprising a sensing device arranged to rest on the bale and fastened to said carrier.

5. An arrangement as defined in claim 1 further comprising a fiber material layer guide fastened to said second frame.

6. An arrangement as defined in claim 1 further comprising a layer abutment secured to said carrier for limiting the depth to which material is removed from the bale.

7. An arrangement as defined in claim 1 wherein said carrier is dimensioned for permitting the horizontal displacement of said first frame to occur over a path having a length at least equal to the dimension of the bale in the direction of that path.

8. An arrangement as defined in claim 1 wherein the horizontal movement of said first frame is transverse to the conveying direction of said belt.

* * * * *